US010111002B1

(12) United States Patent
Poulad

(10) Patent No.: US 10,111,002 B1
(45) Date of Patent: Oct. 23, 2018

(54) DYNAMIC AUDIO OPTIMIZATION

(75) Inventor: Navid Poulad, Sunnyvale, CA (US)

(73) Assignee: Amazon Technologies, Inc., Seattle, WA (US)

( * ) Notice: Subject to any disclaimer, the term of this patent is extended or adjusted under 35 U.S.C. 154(b) by 639 days.

(21) Appl. No.: 13/566,397

(22) Filed: Aug. 3, 2012

(51) Int. Cl.
*H04R 5/02* (2006.01)
*H04H 60/45* (2008.01)
*H04S 7/00* (2006.01)
*H04H 60/04* (2008.01)

(52) U.S. Cl.
CPC ..... *H04R 5/02* (2013.01); *H04H 60/04* (2013.01); *H04H 60/45* (2013.01); *H04S 7/303* (2013.01)

(58) Field of Classification Search
CPC .. H04R 5/02; H04R 3/12; H04S 7/301; H04S 1/0021; H04S 7/302; H04S 7/303; H04H 60/45–60/53; H04H 60/04
USPC ..... 381/303
See application file for complete search history.

(56) References Cited

U.S. PATENT DOCUMENTS 4,953,223 A * 8/1990 Householder ..... 381/387
5,616,876 A * 4/1997 Cluts ..... G06F 17/30749 348/E7.071
5,666,426 A * 9/1997 Helms ..... H03G 3/32 381/104
5,809,150 A * 9/1998 Eberbach ..... 381/300
6,088,455 A * 7/2000 Logan et al. ..... 380/200
6,192,340 B1 * 2/2001 Abecassis ..... G10H 1/0058 455/185.1
6,652,046 B2 * 11/2003 Christner ..... H04R 9/00 312/111
7,028,082 B1 * 4/2006 Rosenberg ..... H04H 60/02 707/999.104
8,184,835 B2 * 5/2012 Goodwin ..... H04R 1/40 381/182
8,255,948 B1 * 8/2012 Black et al. ..... 725/35
8,739,207 B1 * 5/2014 Black et al. ..... 725/35
9,258,665 B2 * 2/2016 Whitley ..... H04H 60/04
2003/0031333 A1 * 2/2003 Cohen ..... H04S 7/301 381/303
2003/0039366 A1 * 2/2003 Eid et al. ..... 381/27
2003/0079038 A1 * 4/2003 Robbin et al. ..... 709/232
2003/0212786 A1 * 11/2003 Jystad et al. ..... 709/224
2005/0166135 A1 * 7/2005 Burke et al. ..... 715/500.1
2006/0107281 A1 * 5/2006 Dunton ..... H03J 1/0025 725/11

(Continued)

FOREIGN PATENT DOCUMENTS

EP 2181895 A2 * 5/2010 ..... B60R 11/0217
WO WO2011088053 7/2011

OTHER PUBLICATIONS

Pinhanez, "The Everywhere Displays Projector: A Device to Create Ubiquitous Graphical Interfaces", IBM Thomas Watson Research Center, Ubicomp 2001, 18 pages.

*Primary Examiner* — Fan Tsang
*Assistant Examiner* — Angelica M McKinney
(74) *Attorney, Agent, or Firm* — Lee & Hayes, PLLC

(57) ABSTRACT

An environment detection node supports dynamic audio optimization by receiving data from sensors and analyzing the received data to detect objects such as furniture and/or humans within an environment. Based on locations within the environment of the detected objects, the environment detection node determines an optimized target location and adjusts audio output to be optimized when heard at the target location.

38 Claims, 6 Drawing Sheets

(56) References Cited

U.S. PATENT DOCUMENTS

2006/0184800 A1* 8/2006 Rosenberg ..... 713/186
2007/0011196 A1* 1/2007 Ball ..... H04H 60/45
2007/0116306 A1 5/2007 Riedel et al.
2007/0124293 A1* 5/2007 Lakowske ..... G06F 17/30743
2007/0220552 A1* 9/2007 Juster ..... H04N 21/4825 725/46
2008/0037803 A1* 2/2008 Breed ..... 381/86
2008/0040758 A1* 2/2008 Beetcher ..... H04N 5/44543 725/81
2008/0130958 A1* 6/2008 Ziomek ..... H03G 3/3005 382/116
2008/0153537 A1* 6/2008 Khawand ..... H03G 3/32 455/550.1
2008/0176511 A1* 7/2008 Tan ..... H04H 60/80 709/201
2009/0138805 A1* 5/2009 Hildreth ..... G06K 9/00335 715/745
2009/0304205 A1* 12/2009 Hardacker ..... H03G 3/301 381/104
2011/0009841 A1* 1/2011 Ahmed ..... A61L 15/56 604/370
2011/0069841 A1* 3/2011 Angeloff et al. ..... 381/17
2011/0164763 A1* 7/2011 Ogata ..... G11B 20/10527 381/107
2011/0222715 A1* 9/2011 Sato et al. ..... 381/303
2012/0128173 A1* 5/2012 Whikehart et al. ..... 381/77
2012/0185769 A1* 7/2012 Whitley ..... H04H 60/04 715/716
2012/0223885 A1 9/2012 Perez
2012/0230525 A1* 9/2012 Higuchi ..... H04N 5/602 381/303
2013/0279706 A1* 10/2013 Marti ..... 381/57
2013/0329921 A1* 12/2013 Salsman ..... 381/303
2013/0336094 A1* 12/2013 Gruteser ..... G01S 11/14 367/117
2015/0010169 A1* 1/2015 Popova ..... H04S 7/303 381/107

* cited by examiner

DYNAMIC AUDIO OPTIMIZATION

BACKGROUND

Many home theater systems provide users with the opportunity to calibrate the speakers of the home theater system to provide optimum sound quality at a particular location. For example, if a user has a favorite seat on the couch in the family room, the home theater system can be calibrated to provide optimum sound quality for anyone sitting in that particular seat on the couch. However, because the sound is only optimized for a single location, the sound is not optimized at other locations within the room. Furthermore, it is typically a tedious process to optimize the sound quality for a particular location, making it undesirable to frequently modify the sound optimization.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

DETAILED DESCRIPTION

Figure 1:
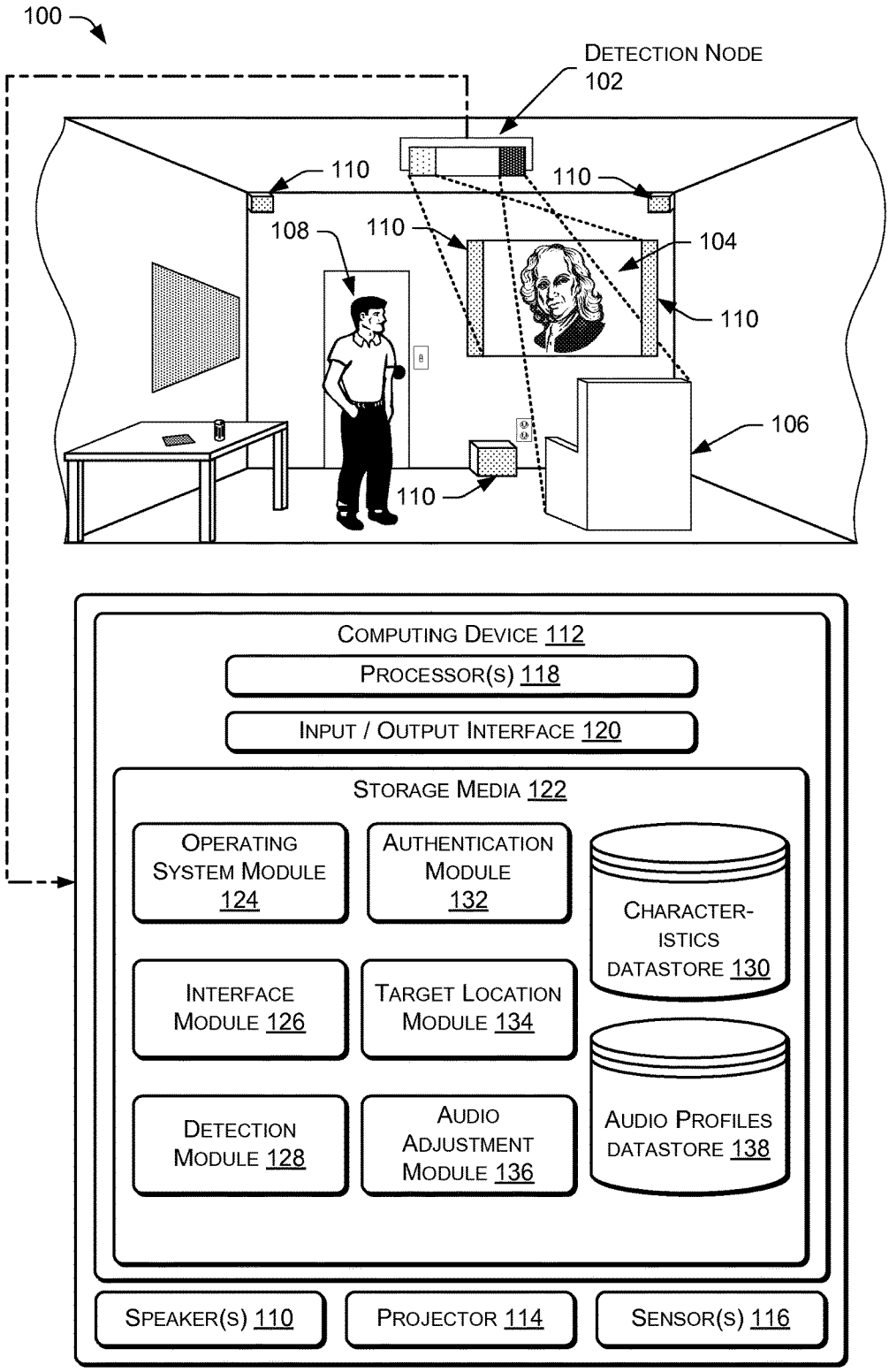
FIG. 1 shows an illustrative home theater environment that includes a detection node configured to perform dynamic audio optimization.

This disclosure describes systems and techniques for an environment detection node (EDN) that implements some or all of an automated dynamic audio optimization system. The EDN includes one or more sensors—such as image capturing sensors, heat sensors, motion sensors, auditory sensors, and so forth—that capture data from an environment, such as a room, hall, yard, or other indoor or outdoor area. The EDN monitors the environment and detects characteristics of the environment including physical characteristics such as floor, ceiling, and wall surfaces and the presence of humans and/or furniture locations in the environment based on the captured data, such as by recognizing an object and/or distinguishing a particular object from other objects in the environment. The characteristics of an object—such as size, structure, shape, movement patterns, color, noise, facial features, voice signatures, heat signatures, gait patterns, and so forth—are determined from the captured data. Based on the detected objects and/or humans, the EDN determines an optimized target location based on locations of the recognized objects and/or humans. The optimized target location is determined such that when audio output is optimized for the target location, the audio output is optimized for the detected objects and/or humans within the environment. As humans move about within the environment, the optimized target location may be adjusted so that the audio output remains optimized for the humans within the environment.

In response to determining an optimized target location, the EDN causes audio output to be optimized for the target location. Audio may be output through the EDN or audio may be output through a separate device (e.g., a home theater system) that is communicatively connected to the EDN. In an example implementation, the optimized target location may be determined initially based on furniture locations (or locations of other inanimate objects) in the environment, and may then be dynamically modified as humans enter, move about, and/or leave the environment. Furthermore, the optimized target location may be dynamically modified based on user preferences associated with specific humans identified within the environment and/or based on audio content that is currently being output. In addition to dynamically optimizing the audio output based on a determined target location, the EDN may also determine one of multiple available audio output devices to output the audio and may adjust the audio output (e.g., equalizer values) based on audio characteristics of the environment, the audio content, and/or user profiles associated with humans identified within the environment.

For example, based on detected floor, ceiling, and wall surfaces and/or based on sound detected in the environment, the EDN may determine audio characteristics of the room. For instance, a room with tile floor and walls (e.g., a bathroom) may exhibit more echo than a room with plaster walls and a carpeted floor. Detected audio characteristics include but are not limited to levels of echo, reverb, brightness, background noise, and so on.

Illustrative Environment

FIG. 1 shows an illustrative home theater environment 100 that includes an environment detection node (EDN) 102 configured to perform the techniques described herein. While the environment 100 illustrates a single EDN 102, in some instances an environment may include multiple different EDNs stationed in different locations throughout the environment, and/or in adjacent environments. When active, the EDN 102 may project content 104 onto any surface within the environment 100. The projected content may include electronic books, videos, images, interactive menus, or any other sort of visual and/or audible content.

In addition the EDN 102 may implement all or part of a dynamic audio optimization system. To do so, the EDN 102 scans the environment 100 to determine characteristics of the environment, including the presence of any objects, such as a chair 106 and/or a human 108 within the environment 100. The EDN 102 may keep track of the objects within the environment 100 and monitor the environment for objects that are newly introduced or objects that are removed from the environment. Based on the objects that are identified at any given time, the EDN 102 determines an optimized target location and optimizes audio output from speakers 110 based on the determined target location. That is, the EDN 102 may alter settings associated with the audio output to optimize the sound at that location. This may include selecting one or more speakers to turn on or off, adjusting settings of the speakers, adjusting the physical position (e.g., via motors) of one or more of the speakers, and the like.

For example, the EDN 102 may first identify furniture locations within the environment 100 by identifying the chair 106. Because the chair 106 is the only furniture that provides seating, the location of the chair may be identified as the optimized target location within the environment 100. In an alternate environment that includes multiple seating locations (e.g., a couch and a chair) an average location based on each seating location may be selected as the optimized target location, or an optimized target location may be selected based on the location of users within the environment. For instance, if a user is in a first chair but a second chair is unoccupied, then the EDN 102 may optimize the sound at the location of the first chair. If users are sitting in both the first and second chair, however, then the EDN 102 may select a location in the middle of the chairs as the location at which to optimize the sound.

In another example, when the EDN 102 identifies the presence of the human 108 and the EDN determines that no one is sitting in the chair 106, the optimized target location may be dynamically adjusted to the location of the human 108 rather than related to the furniture. In an example implementation, when multiple humans are identified within the environment 100, an average location based on the locations of each of the identified humans may be determined to be the optimized target location. Similarly, as one or more humans move about within the environment, the optimized target location may be dynamically modified.

After identifying the optimized target location, the EDN 102 adjusts audio output based, at least in part, on the determined target location. For example, the EDN 102 adjusts equalizer values (e.g., treble and bass), volume, sound delay, speaker positions, and so on for each of multiple speakers 110 so that the sound quality is optimum at the determined target location.

If the optimized target location is based on the detection of a particular human, the sound quality may also be adjusted based on a user profile associated with the particular human. For example, in a family setting, a teenage boy may prefer an audio adjustment that includes more bass, while a mother may prefer an audio adjustment with less bass. In some instances, the EDN may include sensors (e.g., a camera, a microphone) to identify users based on facial recognition techniques, audio recognition techniques, and/or the like.

The EDN may also adjust the sound quality based, at least in part, on the audio content that is being output. For example, the EDN may use different adjustments for televised sporting events, classical music, action movies, children's television programs, or any other genre of audio output.

As illustrated, the EDN 102 comprises a computing device 112, one or more speakers 110, a projector 114, and one or more sensor(s) 116. Some or all of the computing device 112 may reside within a housing of the EDN 102 or may reside at another location that is operatively connected to the EDN 102. For example, the speakers 110 may be controlled by a home theater system separate from the EDN 102. The computing device 112 comprises one or more processor(s) 118, an input/output interface 120, and storage media 122. The processor(s) 118 may be configured to execute instructions that may be stored in the storage media 122 or in other storage media accessible to the processor(s) 118.

The input/output interface 120, meanwhile, may be configured to couple the computing device 112 to other components of the EDN 102, such as the projector 114, the sensor(s) 116, other EDNs 102 (such as in other environments or in the environment 100), other computing devices, network communication devices (such as modems, routers, and wireless transmitters), a home theater system, and so forth. The coupling between the computing device 112 and other devices may be via wire, fiber optic cable, wireless connection, or the like. The sensors may include, in various embodiments, one or more image sensors such as one or more cameras (including a motion camera, a still camera, an RGB camera), a ToF sensor, audio sensors such as microphones, ultrasound transducers, heat sensors, motion detectors (including infrared imaging devices), depth sensing cameras, weight sensors, touch sensors, tactile output devices, olfactory sensors, temperature sensors, humidity sensors, and pressure sensors. Other sensor types may be utilized without departing from the scope of the present disclosure.

The storage media 122, meanwhile, may include computer-readable storage media ("CRSM"). The CRSM may be any available physical media accessible by a computing device to implement the instructions stored thereon. CRSM may include, but is not limited to, random access memory ("RAM"), read-only memory ("ROM"), electrically erasable programmable read-only memory ("EEPROM"), flash memory, or other memory technology, compact disk read-only memory ("CD-ROM"), digital versatile disks ("DVD") or other optical disk storage, magnetic cassettes, magnetic tape, magnetic disk storage or other magnetic storage devices, or any other medium which can be used to store the desired information and which can be accessed by a computing device 112. The storage media 122 may reside within a housing of the EDN, on one or more storage devices accessible on a local network, on cloud storage accessible via a wide area network, or in any other accessible location.

The storage media 122 may store several modules, such as instructions, datastores, and so forth that are configured to execute on the processor(s) 118. For instance, the storage media 122 may store an operating system module 124, an interface module 126, a detection module 128, a characteristics datastore 130, an authentication module 132, a target location module 134, an audio adjustment module 136, and an audio profiles datastore 138.

The operating system module 124 may be configured to manage hardware and services within and coupled to the computing device 112 for the benefit of other modules. The interface module 126, meanwhile, may be configured to receive and interpret commands received from users within the environment 100. For instance, the interface module 126 may analyze and parse images captured by one or more cameras of the sensor(s) 116 to identify objects and users within the environment 100 and to identify gestures made by users within the environment 100, such as gesture commands to project display content. In other instances, the interface module 126 identifies commands audibly issued by users within the environment and captured by one or more microphones of the sensor(s) 116. In still other instances, the interface module 126 allows users to interface and interact with the EDN 102 in any way, such as via physical controls, and the like.

The detection module 128, meanwhile, receives data from the sensor(s) 116, which may be continuously or periodically monitoring the environment 100 by capturing data from the environment. For example, the detection module 128 may receive video or still images, audio data, infrared images, and so forth. The detection module 128 may receive data from active sensors, such as ultrasonic, microwave, radar, light detection and ranging (LIDAR) sensors, and the like. From the perspective of a human 108 within the environment, the sensing of the data from the environment may be passive or may involve some amount of interaction with the sensor(s) 116. For example, a person may interact with a fingerprint scanner, an iris scanner, or a keypad within the environment 100.

The detection module 128 may detect in real-time, or near real-time, the presence of objects, such as the human 108, within the environment 100 based on the received data. This may include detecting motion based on the data received by the detection module 128. For example, the detection module 128 may detect motion in the environment 100, an altered heat signature within the environment 100, vibrations (which may indicate a person walking within the environment 100), sounds (such as people talking), increased/decreased humidity or temperature (which may indicate more or fewer humans within an interior environment), or other data that indicates the presence or movement of an object within the environment 100.

The detection module 128 determines one or more characteristics of identified humans, such as the human 108, using the captured data. As with detection, sensing of the data from the environment used to determine characteristics of the human 108 may either be passive from the perspective of the human 108 or involve interaction by the human 108 with the environment 100. For example, the human 108 may pick up a book and turn to a particular page, the human 108 may tap a code onto a wall or door of the environment 100, or the human 108 may perform one or more gestures. Other interactions may be used without departing from the scope of embodiments.

The characteristics of the human 108 may be usable to determine, or attempt to determine, an identity of the human 108. For example, the characteristics may be facial characteristics captured using one or more images, as described in more detail below. The characteristics may include other biometrics such as gait, mannerisms, audio characteristics such as vocal characteristics, olfactory characteristics, walking vibration patterns, and the like. The detection module 128 attempts to determine the identity of a detected human, such as the human 108, based at least on one or more of the determined characteristics, such as by attempting to match one or more of the determined characteristics to characteristics of known humans in the characteristics datastore 130.

Where the determined characteristics match the known characteristics within a threshold likelihood, such as at least 80%, 90%, 99.9%, or 99.99% likelihood, the detection module 128 determines that a detected human is "known" and identified. For instance, if a system is more than 95% confident that a detected human is a particular human (e.g., the mom in the household), then the detection module 128 may determine that the detected human is known and identified. The detection module 128 may use a combination of characteristics, such as face recognition and vocal characteristics, to identify the human.

The detection module 128 may interact with the authentication module 132 to further authenticate the human, such as by active interaction of the human with the environment 100. For example, the human 108 may perform one or more authentication actions, such as performing a physical gesture, speaking a password, providing voice input, code or passphrase, tapping a pattern onto a surface of the environment 100, interacting with a reference object (such as a book, glass, or other item in the environment 100), or engaging in some other physical action that can be used to authenticate the human 108. The authentication module 132 may utilize speech recognition to determine a password, code, or passphrase spoken by the human. The authentication module 132 may extract voice data from audio data (such as from a microphone) to determine a voice signature of the human, and to determine the identity of the human based at least on a comparison of the detected voice signature with known voice signatures of known humans. The authentication module 132 may perform one or more of these actions to authenticate the human, such as by both comparing a voice signature to known voice signatures and listening for a code or password/passphrase. In other examples, the human 108 performs a secret knock on a door; the human 108 picks up a book and open the book to specified page in order to be authenticated; or the human 108 picks up an object and places it into a new location within the environment such as on a bookcase, or into his or her pocket, in order to authenticate. Other examples are possible without departing from the scope of embodiments. The authentication module 132 may receive sensor data from the one or more sensor(s) 116 to enable the authentication.

Authenticating the human may be in addition to, or instead of, determining an identity of the human by the detection module 128.

The target location module 134, meanwhile, is configured to determine an optimized target location based on data that is received through the sensor(s) 116 and analyzed by the detection module 128. For example, based on the data received through the sensor(s) 116, the detection module 128 may determine one or more seating locations based on a furniture configuration, may determine locations of one or more humans within the environment, and/or may identify one or more humans within the environment. Based on any combination of determined seating locations, locations of determined humans, and/or identities of particular determined humans, the target location module 134 determines an optimized target location.

The target location module 134 may initially determine the optimized target location based solely on detected furniture locations, and then, as humans are detected within the environment, the target location module 134 may dynamically adjust the optimized target location based on the locations of the detected and/or identified humans. In an example implementation, the optimized target location based solely on the detected furniture locations may be maintained and used as a default optimized target location, for example, each time the EDN 102 is powered on.

The target location module 134 may use any of multiple techniques to determine the optimized target location. For example, if only a single seating area or a single human is detected in the environment 100, then the target location module 134 may determine the optimized target location to be the location that corresponds to the single detected seating location or human. If multiple seating locations and/or humans are detected, target location module 134 may determine the optimized target location to be the location that corresponds to a particular one of the detected seating areas or humans. For example, if the detection module 128 detects one adult-size recliner and several child-size chairs within the environment, the target location module 134 may determine the optimized target location to be the location that corresponds to the single adult-size recliner. Similarly, the target location module 134 may determine the optimized target location to be the location that corresponds to a particular detected human (e.g., the only adult in an environment with other detected children).

As another example, the target location module 134 may determine the optimized target location based on locations of multiple detected seating locations and/or humans. For example, the target location module 134 may determine the optimized target location to be an average location based on locations corresponding to the multiple detected seating areas and/or humans.

Once the target location module 134 has determined the optimized target location, the audio adjustment module 136 causes the audio output to be optimized for the target location. For example, the audio adjustment module 136 sends commands to speakers 110 (or to a home theater system that controls the speakers) to adjust, for instance, the volume, bass level, treble level, physical position, and so on, of each speaker so that the audio quality is optimized at the determined target location.

In addition to optimizing the audio output for the determined particular location, the audio adjustment module 136 may also be configured to adjust the audio output based on user preferences. For example, if the detection module 128 or the authentication module 132 identifies a particular human within the environment, an audio profile associated with the particular human may be accessed in audio profiles datastore 138. The audio profile may indicate user preferences, for example, for volume, treble, and bass values. If such a profile exists for an identified human, the audio adjustment module 136 may further adjust the audio output according to the profile data.

Furthermore, the audio adjustment module 136 may also be configured to adjust the audio output based on detected audio characteristics of the environment. For example, if the detection module 128 detects environmental characteristics that affect audio quality (e.g., hard surface walls, small enclosed space, etc.), the audio adjustment module 136 may further adjust the audio output to compensate for the detected audio characteristics of the environment.

Illustrative Processes

FIGS. 2-6 show illustrative processes for dynamically adjusting audio output. The processes may be implemented by the architectures described herein, or by other architectures. These processes are illustrated as collections of blocks in logical flow graphs. Some of the blocks represent operations that can be implemented in hardware, software, or a combination thereof. In the context of software, the blocks represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described blocks can be combined in any order or in parallel to implement the processes. It is understood that the following processes may be implemented with other architectures as well.

Figure 2:
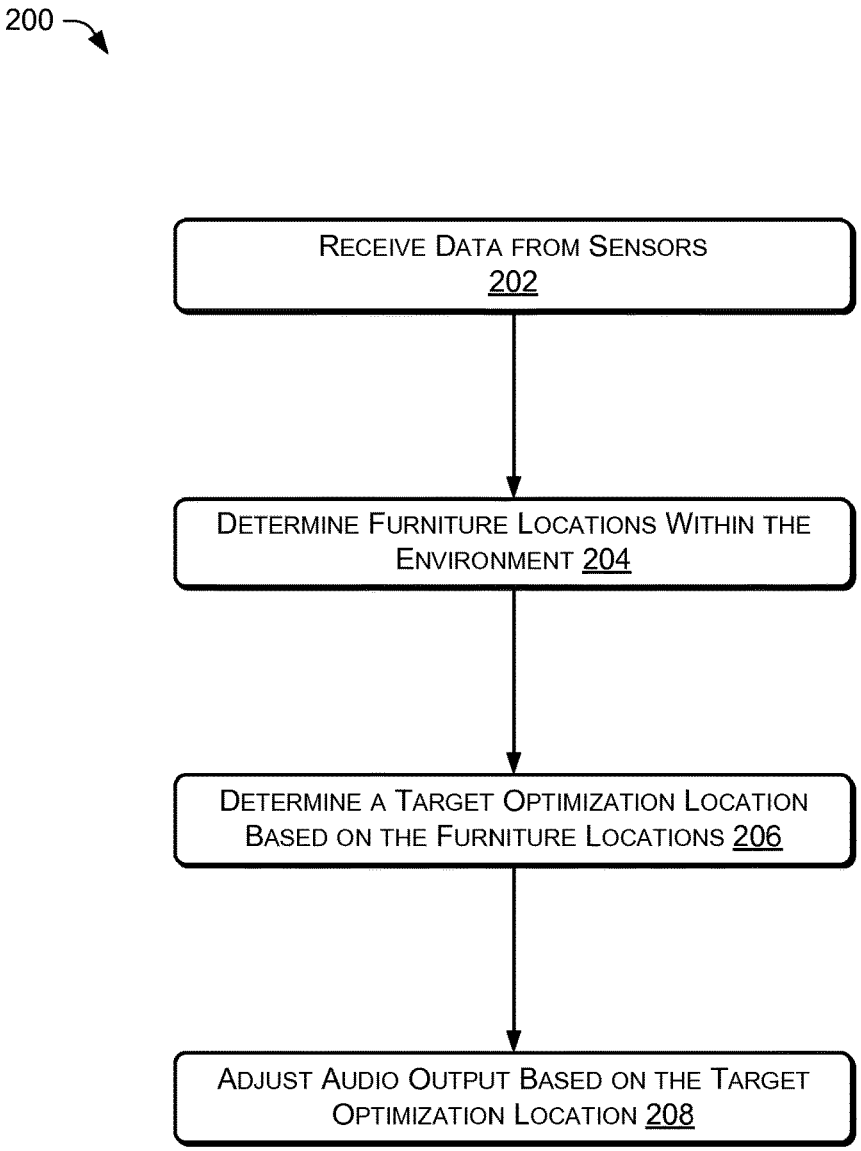
FIG. 2 presents a flow diagram showing an illustrative process of optimizing audio output based on determined furniture locations within an environment.

FIG. 2 shows an illustrative process 200 for optimizing audio output based on detected furniture locations within an environment.

At 202, the EDN 102 receives data from sensors 116. For example, the detection module 128 may receive one or more images captured by an image capturing sensor.

At 204, the EDN 102 determines furniture locations within the environment. For example, the detection module 128 may analyze the captured images to identify one or more seating locations based on furniture (e.g., chairs, sofas, etc.) that is depicted in the captured images.

At 206, the EDN 102 determines an optimized target location based on the furniture locations. For example, the detection module 128 may transmit data that identifies one or more seating locations to the target location module 134. The target location module 134 then determines an optimized target location based on the identified seating locations. As an example, if the environment includes only a single seating location (e.g., chair 106 in environment 100), then the target location module 134 may determine that single seating location to be the optimized target location. However, if the environment includes multiple seating locations (e.g., a chair and a sofa), then the target location module 134 may employ one of multiple techniques for determining an optimized target location. In an example implementation, the target location module 134 may select a particular one (e.g., a most centrally located) of the multiple identified seating locations as the optimized target location. Alternatively, the target location module 134 may determine the optimized target location to be an average location based on the locations of the multiple identified seating locations.

In another alternate implementation, the target location module 134 may determine the optimized target location based on a particular seating location that is most frequently used. For example, in a family environment, if the father is most often present when audio is being output in the environment, and the father usually sits in a particular chair, then the target location module 134 may determine the location of that particular chair to be the optimized target location.

At 208, the EDN adjusts audio output based on the determined target location. For example, if the speakers 110 are part of the EDN, the EDN adjusts the volume, bass, and treble of each speaker to optimize the sound quality at the determined target location. In an alternate implementation, if the speakers are separate from the EDN (e.g., part of a home theater system), the EDN communicates optimization commands to the home theater system, directing the home theater system to adjust any combination of the volume, bass, treble, delay, physical position, etc. of each speaker to optimize the sound quality at the determined target location.

Figure 3:
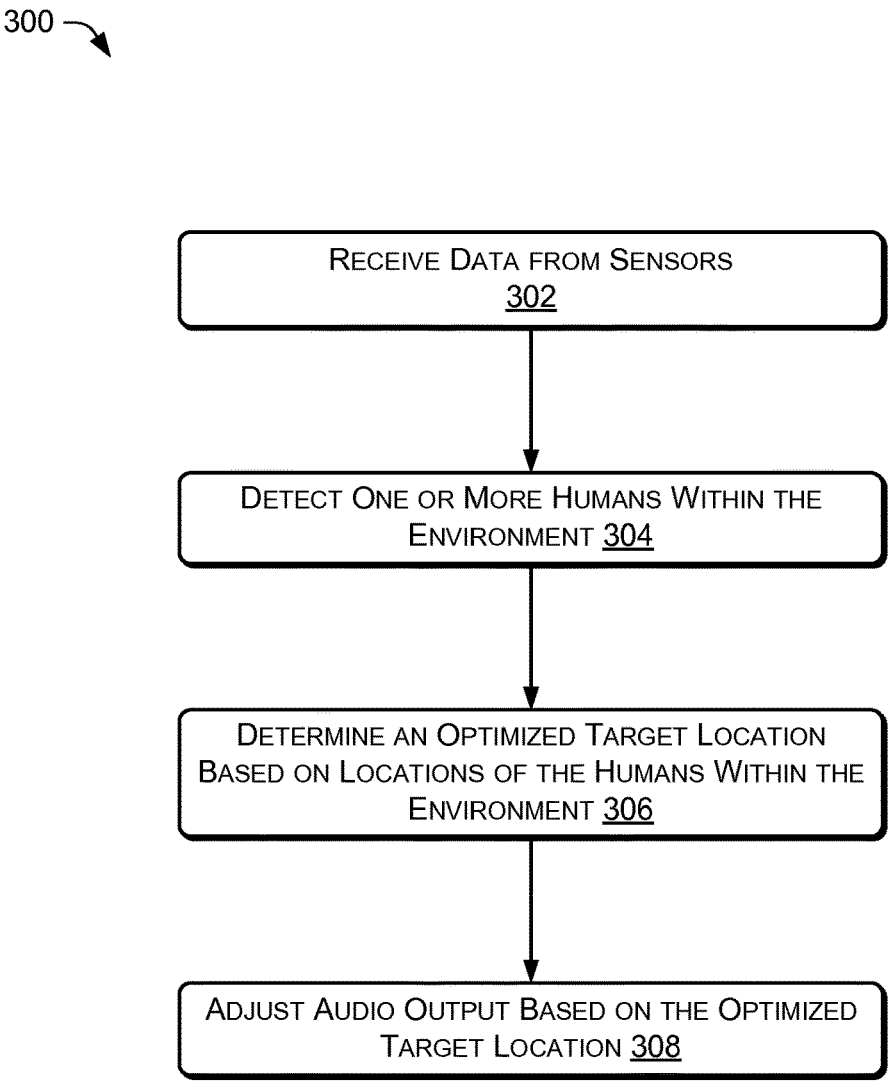
FIG. 3 presents a flow diagram showing an illustrative process of optimizing audio output based on a location of a detected human within an environment.

FIG. 3 shows an illustrative process 300 for optimizing audio output based on a location of a detected human within an environment.

At 302, the EDN 102 receives data from sensors 116. For example, the detection module 128 may receive data from one or more sensors, including image capturing sensors, heat sensors, motion sensors, auditory sensors, and so on.

At 304, the EDN 102 detects one or more humans within the environment. For example, based on the data received from the sensors 116, the detection module 128 determines that there is at least one human within the environment. Such determination may be based on any combination of, for example, image data, heat data, motion data, auditory data, and so on.

At 306, the EDN 102 determines an optimized target location based, at least in part, on locations of the detected humans within the environment. For example, if the detection module 128 identifies a single human within the environment, then the target location module 134 may determine that the optimized target location is a determined location of the detected single human. If the detection module 128 identifies multiple humans within the environment, then the target location module 134 may determine the optimized target location to be an average location based on the locations of the multiple detected humans.

At 308, the EDN adjusts audio output based on the determined target location. For example, if the speakers 110 are part of the EDN, the EDN adjusts the volume, bass, and treble of each speaker to optimize the quality of the audio heard at the determined target location. In an alternate implementation, if the speakers are separate from the EDN (e.g., part of a home theater system), the EDN communicates optimization commands to the home theater system, directing the home theater system to adjust the volume, bass, treble, delay, etc. of each speaker to optimize the quality of the sound heard at the determined target location.

Figure 4:
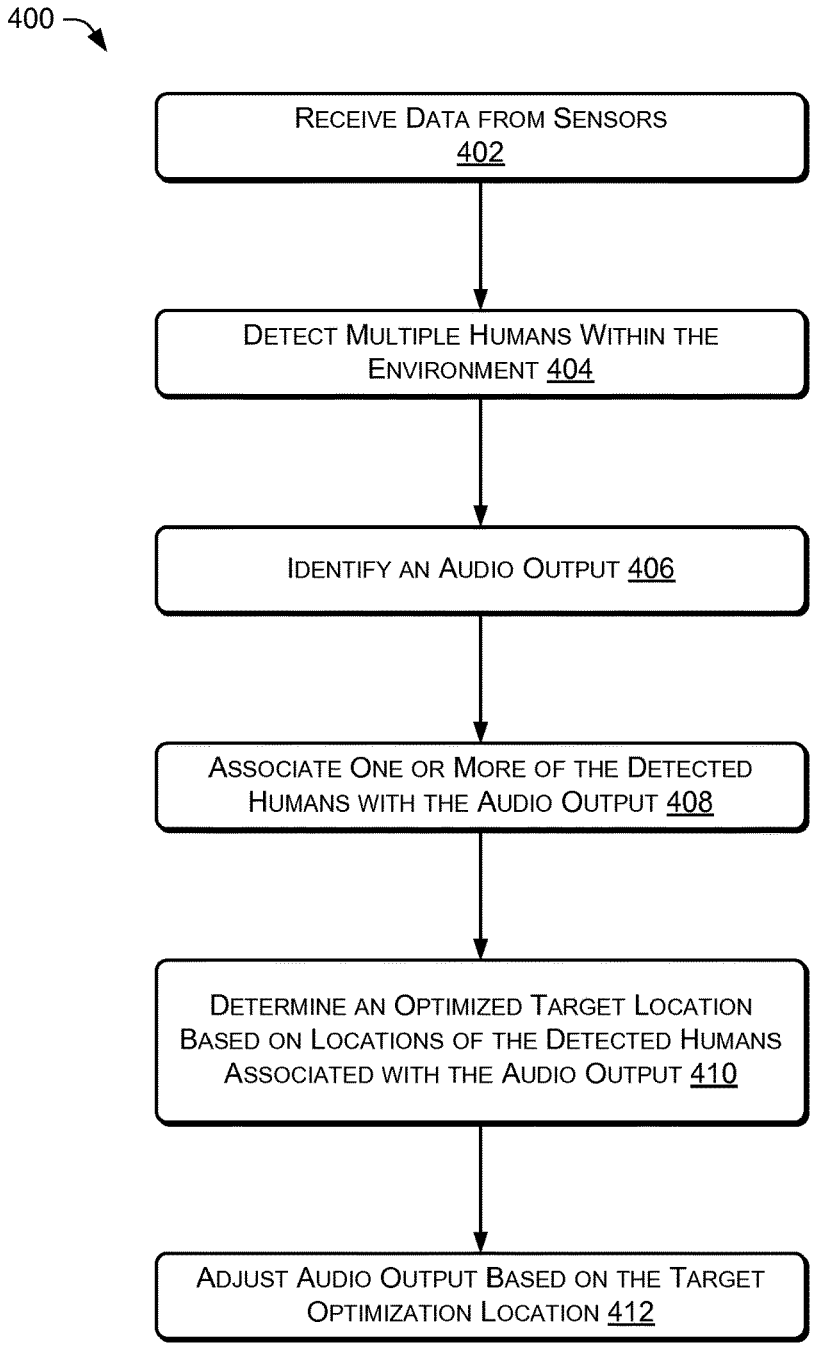
FIG. 4 presents a flow diagram showing an illustrative process of optimizing audio output based on a location within an environment of one or more detected humans associated with the audio output.

FIG. 4 shows an illustrative process 400 for optimizing audio output based on a location within an environment of one or more detected humans associated with the audio output.

At 402, the EDN 102 receives data from sensors 116. For example, the detection module 128 may receive data from one or more sensors, including image capturing sensors, heat sensors, motion sensors, auditory sensors, and so on.

At 404, the EDN 102 detects multiple humans within the environment. For example, based on the data received from the sensors 116, the detection module 128 determines that there are multiple humans within the environment. Such determination may be based on any combination of, for example, image data, heat data, motion data, auditory data, and so on.

At 406, the EDN 102 identifies an audio output. For example, the EDN determines what type of audio content is being output. If the EDN 102 is providing the audio output, the EDN 102 may identify the audio output based on a source of the audio output (e.g., a particular television program, a particular song, a particular video, etc.). If the EDN is not providing the audio output, the EDN 102 may identify the audio output based on data (e.g., audio data) received from the sensors 116. Alternatively, if the audio output is being provided through a home theater system, the EDN 102 may identify the audio output based on data requested and received from the home theater system.

At 408, the EDN 102 associates one or more of the detected humans with the audio output. For example, based on characteristics datastore 130, the detection module 128 may determine specific identities of one or more of the detected humans. Alternatively, the detection module 128 may determine characteristics of the detected humans, even though the detection module 128 may not positively identify the humans. The identities and/or the determined characteristics may indicate, for example, at least an approximate age and/or gender of each human.

Based on the determined identities and/or characteristics, the target location module 134 associates one or more of the detected humans with the audio output. For example, if the detected humans include one or more adult males and one or more children, and the audio output is identified to be a televised sporting event, then the target location module 134 may associate each of the adult male humans with the audio output while not associating each of the children with the audio output. Similarly, if the detected humans include one or more children and one or more adults, and the audio content is determined to be a children's television program, then the target location module 134 may associate each of the children with the audio output while not associating each of the adults with the audio output. These associations may be made with reference to an array of characteristics associated with the audio, such as a title of the audio, a genre of the audio, a target age range associated with the audio, and the like.

At 410, the EDN 102 determines an optimized target location based, at least in part, on locations of the detected humans within the environment that are associated with the audio output. For example, if the target location module 134 associates a single human within the environment with the audio output, then the target location module 134 may determine that the optimized target location is a determined location of that single human. If the target location module 134 associates multiple humans within the environment with the audio output, then the target location module 134 may determine the optimized target location to be an average location based on the locations of those multiple humans.

At 412, the EDN adjusts audio output based on the determined target location. For example, if the speakers 110 are part of the EDN, the EDN adjusts the volume, bass, treble, delay, physical position, etc. of each speaker to optimize the quality of the sound heard at the determined target optimization location. In an alternate implementation, if the speakers are separate from the EDN (e.g., part of a home theater system), the EDN communicates optimization commands to the home theater system, directing the home theater system to adjust the volume, bass, treble, delay, physical position, etc. of each speaker to optimize the quality of the sound heard at the determined target location.

In addition to optimizing the audio quality at a particular location, EDN 102 may also adjust the audio output based on preferences of specific humans and/or based on detected audio characteristics of the environment.

Figure 5:
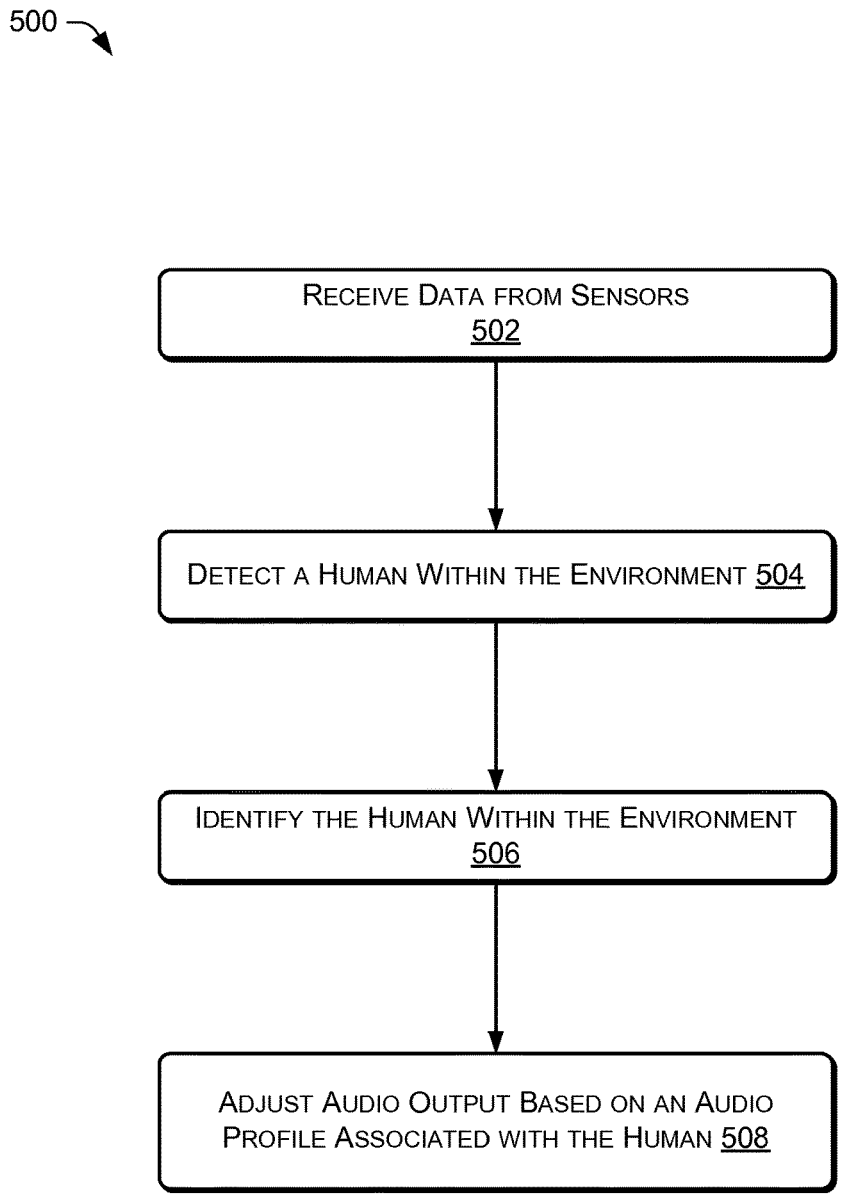
FIG. 5 presents a flow diagram showing an illustrative process of adjusting audio output based on an audio profile associated with a particular human detected within an environment.

FIG. 5 shows an illustrative process 500 for adjusting audio output based on an audio profile associated with a particular human detected within an environment.

At 502, the EDN 102 receives data from sensors 116. For example, the detection module 128 may receive data from one or more sensors, including image capturing sensors, heat sensors, motion sensors, auditory sensors, and so on.

At 504, the EDN 102 detects one or more humans within the environment. For example, based on the data received from the sensors 116, the detection module 128 determines that there is at least one human within the environment. Such determination may be based on any combination of, for example, image data, heat data, motion data, auditory data, and so on.

At 506, the EDN 102 identifies a particular human within the environment. For example, the detection module 128 may compare characteristics of a detected human to known characteristics in characteristics datastore 130 to positively identify a particular human. Alternatively, the authentication module 132 may positively identify a particular human based on one or more authentication techniques.

At 508, the EDN 102 adjusts audio output based on an audio profile associated with the identified human. For example, an audio profile may be stored in the audio profiles datastore 138 in association with the identified human. The audio profile may indicate the particular human's preferences for audio quality including, for example, preferred volume, bass, and treble levels. Based on the identified audio profile, the audio adjustment module 136 adjusts the volume, bass, treble, etc. of the audio output, either directly or through communication with the audio source (e.g., a home theater system).

Figure 6:
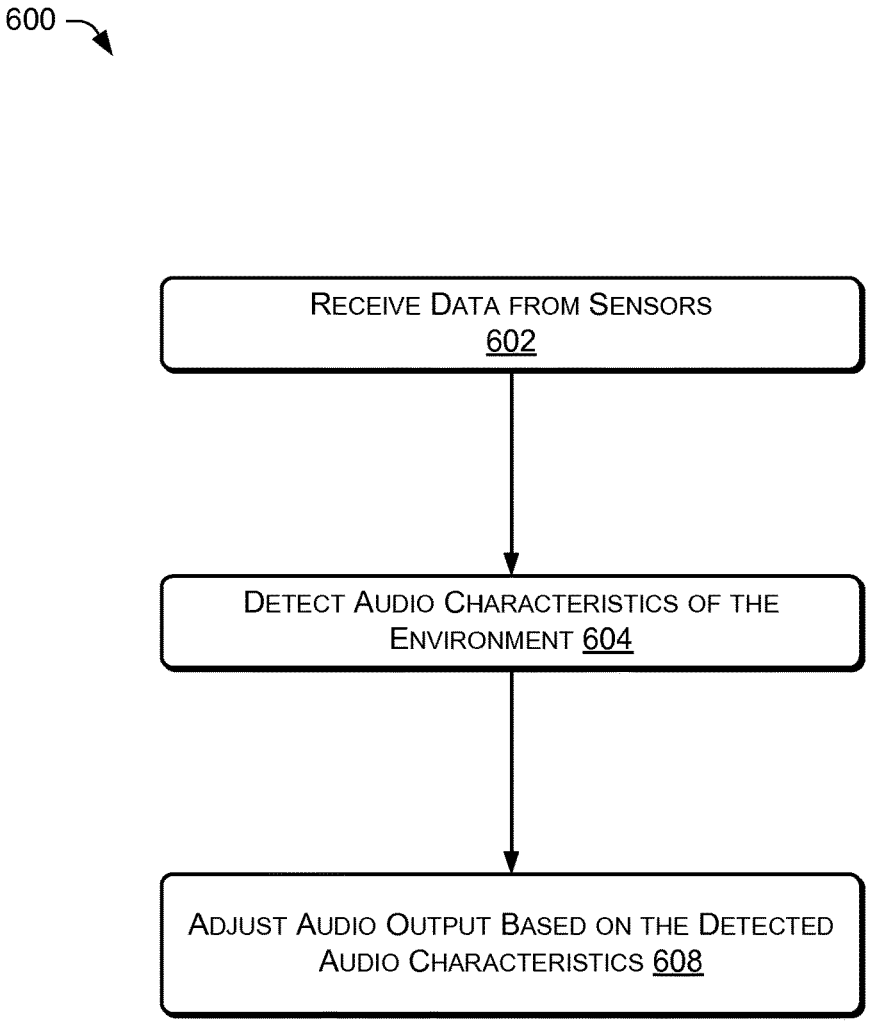
FIG. 6 presents a flow diagram showing an illustrative process of adjusting audio output based on detected audio characteristics of an environment.

FIG. 6 shows an illustrative process 600 for adjusting audio output based on detected audio characteristics within an environment.

At 602, the EDN 102 receives data from sensors 116. For example, the detection module 128 may receive data from one or more sensors, including image capturing sensors, heat sensors, motion sensors, auditory sensors, and so on.

At 604, the EDN 102 detects one or more audio characteristics of the environment. For example, based on the data received from the sensors 116, the detection module 128 determines characteristics of the environment that may affect audio quality. For example, audio quality may be affected by the size of the environment, the surfaces of walls, ceilings, and floors, the furnishings (or lack thereof) within the environment, background noise, and so on. For example, a small room with tile surfaces (e.g., a bathroom) or a large room void of furnishings may have an echoing and/or reverb affect on audio. Similarly, room with plush carpeting and heavy upholstered furniture may have a sound-absorbing affect on audio. Such determination may be based on any combination of, for example, image data, heat data, auditory data, and so on.

At 606, the EDN 102 adjusts audio output based on the detected audio characteristics of the environment. For example, the audio adjustment module 136 adjusts any combination of the volume, bass, treble, reverb, delay, etc. of the audio output, either directly or through communication with the audio source (e.g., a home theater system), to counteract the detected audio characteristics of the environment.

CONCLUSION

Although the subject matter has been described in language specific to structural features, it is to be understood that the subject matter defined in the appended claims is not necessarily limited to the specific features described. Rather, the specific features are disclosed as illustrative forms of implementing the claims.

What is claimed is:

1. An audio optimization system comprising:

one or more processors;

one or more sensors communicatively coupled to the one or more processors; and one or more computer-readable storage media storing one or more computer-executable instructions that are executable by the one or more processors to:

receive data from the one or more sensors;

analyze the data to determine objects within an environment, the environment including a plurality of speakers that output audio;

detect audio characteristics of the audio being output;

determine locations based on the data, wherein each location is associated with a corresponding object of the objects;

identify, based on the objects, a first human and a second human, the first human being at a first location and the second human being at a second location;

select a new location based on the first location and the second location, wherein the new location is between the first location and the second location;

determine, from the data, user authentication information associated with at least one of the first human or the second human, the user authentication information comprising at least one of a pattern tapped onto a surface of the environment or user interaction with a reference object;

determine, based on at least one of the audio characteristics or the user authentication, that the first human or the second human is likely to have a higher interest in the audio; and adjust audio output from a plurality of speakers to optimize the audio at the new location by instructing a first speaker of the plurality of speakers to output the audio at a first volume level and instructing a second speaker of the plurality of speakers to output the audio at a second volume level that is different than the first volume level such that a first detected volume level of the audio received from the first speaker at the new location is substantially equal to a second detected volume level of the audio received from the second speaker at the new location.

2. The audio optimization system as recited in claim 1, wherein the objects include furniture.

3. The audio optimization system as recited in claim 1, wherein the one or more computer-executable instructions are further executable by the one or more processors to determine an identity of at least one of the first human or the second human by comparing one or more determined characteristics to characteristics of one or more known humans.

4. The audio optimization system as recited in claim 1, wherein the one or more computer-executable instructions are further executable by the one or more processors to determine an identity of at least one of the first human or the second human based at least in part on the authentication information.

5. The audio optimization system as recited in claim 4, wherein:

the one or more sensors detect an authentication action performed by the at least one of the first human or the second human; and the one or more computer-executable instructions are further executable by the one or more processors to receive the authentication information from the one or more sensors, wherein the authentication information represents the authentication action.

6. The audio optimization system as recited in claim 1, wherein the plurality of speakers are associated with a home theater system separate from the audio optimization system.

7. The audio optimization system as recited in claim 1, wherein the one or more computer-executable instructions are further executable by the one or more processors to adjust audio settings based at least in part on an audio profile associated with at least one of the first human or the second human.

8. The audio optimization system as recited in claim 1, wherein the one or more computer-executable instructions are further executable by the one or more processors to further adjust the audio by:

adjusting, for each speaker independently, at least one of a bass level, a treble level, a reverb level, or a delay; or causing a motor associated with a speaker of the plurality of speakers to adjust a physical position of the speaker.

9. The audio optimization system as recited in claim 1, wherein the new location is a location of a particular object within the environment.

10. The audio optimization system as recited in claim 1, wherein the one or more computer-executable instructions are further executable by the one or more processors to adjust the audio from the plurality of speakers to optimize the audio at the new location based at least in part on the audio characteristics.

11. The audio optimization system as recited in claim 1, wherein the one or more computer-executable instructions are further executable by the one or more processors to cause a motor associated with the first speaker to move the first speaker from a first physical location within the environment to a second physical location within the environment to optimize the audio at the new location.

12. A method comprising:

receiving, from one or more sensors, data captured by the one or more sensors from an environment, the environment including at least a first speaker at a first physical location within the environment, a second speaker outputting audio, and a plurality of inanimate objects;

determining at least one audio characteristic of the audio being output;

based at least in part on the data, determining a plurality of locations, wherein individual locations of the plurality of locations are associated with an inanimate object of the plurality of inanimate objects;

based at least in part on the plurality locations, determining a target location within the environment;

determining a second physical location within the environment from which to output audio to optimize audio output at the target location;

based at least in part on the data, determining user authentication information associated with at least one of a first human or a second human within the environment, the user authentication information comprising at least one of a pattern tapped onto a surface of the environment or user interaction with a reference object;

determining, based at least in part on at least one of the at least one audio characteristic or the user authentication information, that the first human or the second human is likely to have a higher interest in the audio;

causing a motor associated with the first speaker to move the first speaker from the first physical location to the second physical location; and substantially equalizing a first detected volume level of the audio at the target location from the first speaker with a second detected volume level of the audio at the target location from the second speaker by instructing the first speaker to output the audio at a first modified volume level and instructing the second speaker to output the audio at a second modified volume level that is different than the first modified volume level.

13. The method as recited in claim 12, wherein the plurality of inanimate objects include furniture.

14. The method as recited in claim 12, further comprising:

based at least in part on the data, determining that one or more humans reside within the environment, each of the one or more humans being associated with a location within the environment; and based at least in part on the locations associated with the one or more humans, modifying the target location to determine a modified target location.

15. The method as recited in claim 14, further comprising:

substantially equalizing a third detected volume level of the audio at the modified target location from the first speaker with a fourth detected volume level of the audio at the modified target location from the second speaker by instructing the first speaker to output the audio at a third modified volume level and instructing the second speaker to output the audio at a fourth modified volume level that is different than the third modified volume level.

16. The method as recited in claim 12, further comprising:

based at least in part on the data, determining that a plurality of humans reside within the environment, each of the plurality of humans associated with a location within the environment;

based at least in part on the locations associated with the one or more humans, modifying the target location to determine a modified target location; and substantially equalizing a third detected volume level of the audio at the modified target location from the first speaker with a fourth detected volume level of the audio at the modified target location from the second speaker by instructing the first speaker to output the audio at a third modified volume level and instructing the second speaker to output the audio at a fourth modified volume level that is different than the third modified volume level.

17. The method as recited in claim 16, wherein the at least one characteristic of the audio output comprises a media content title, a media content genre, or a target age range.

18. The method as recited in claim 12, further comprising:

based at least in part on the data, determining an identity of the first human;

determining an audio profile associated with the identity of the first human; and based at least in part on the audio profile, adjusting the audio.

19. The method as recited in claim 12, further comprising:

based at least in part on the user authentication information, determining an identity of the first human;

determining an audio profile associated with the identity of the first human; and based at least in part on the audio profile, adjusting the audio.

20. A method as recited in claim 19, wherein the user authentication information comprises at least one of a physical gesture or a voice input.

21. A method comprising:

receiving, from one or more sensors, data captured by the one or more sensors from an environment, the environment including at least a first speaker and a second speaker outputting audio;

based at least in part on the data, determining that a first human and a second human reside within the environment, the first human having a first location within the environment and the second human having a second location within the environment;

determining that the first location is more frequently occupied than the second location;

based at least in part on determining that the first location is more frequently occupied than the second location, substantially equalizing a first detected volume level of the audio at the first location from the first speaker with a second detected volume level of the audio at the first location from the second speaker by instructing the first speaker to output the audio at a first modified volume level and instructing the second speaker to output the audio at a second modified volume level that is different than the first modified volume level;

based at least in part on the data, determining that at least one of the first human or the second human is changing location within the environment to a new location; and substantially equalizing a third detected volume level of the audio at the new location from the first speaker with a fourth detected volume level of the audio at the new location from the second speaker by instructing the first speaker to output the audio at a third modified volume level and instructing the second speaker to output the audio at a fourth modified volume level that is different than the third modified volume level.

22. The method as recited in claim 21, further comprising:

based at least in part on the data, determining an identity of the first human within the environment;

determining an audio profile associated with the identity of the first human; and based at least in part on the audio profile, adjusting the audio.

23. The method as recited in claim 21, further comprising:

identifying user authentication information from the data captured by the one or more sensors;

based at least in part on the user authentication information, determining an identity of the first human within the environment;

determining an audio profile associated with the identity of the first human; and based at least in part on the audio profile, adjusting the audio.

24. The method as recited in claim 21, further comprising:

receiving additional data indicating conditions within the environment that have changed;

at least partly in response to receiving the additional data:

modifying the new location to create a modified location; and adjusting the audio output by the first speaker and the second speaker based at least in part on the modified location.

25. The method as recited in claim 24, wherein the additional data indicates that at least one of the first location of the first human has changed or that the second location of the second human has changed.

26. The method of claim 21, wherein substantially equalizing the third detected volume level of the audio at the new location from the first speaker with the fourth detected volume level of the audio at the new location from the second speaker further comprises causing the first speaker to cease outputting the audio.

27. The method of claim 21, further comprising causing a third speaker to initiate output of the audio at a fifth volume level based at least in part on the new location within the environment.

28. A method comprising:

receiving, from one or more sensors, data captured by the one or more sensors from an environment, the environment including at least a first speaker and a second speaker outputting audio;

based at least in part on the data, detecting a plurality humans within the environment, individual humans of the plurality of humans having an associated location within the environment;

based at least in part on the data, determining user authentication information associated with at least one human of the plurality of humans within the environment, the user authentication information comprising at least one of a pattern tapped onto a surface of the environment or user interaction with a reference object;

identifying audio characteristics of the audio being output;

based at least in part on the audio characteristics or the user authentication information, determining a set of humans of the plurality of humans that are likely to have a higher interest in the audio;

based at least on locations associated with the set of humans, determining an optimized target location within the environment; and substantially equalizing a first detected volume level of the audio at the optimized target location from the first speaker with a second detected volume level of the audio at the optimized target location from the second speaker by instructing the first speaker to output the audio at a first modified volume level and instructing the second speaker to output the audio at a second modified volume level that is different than the first modified volume level.

29. The method as recited in claim 28, wherein:

the audio characteristics include a target age group associated with the audio; and the detecting comprises, for individual humans of the plurality of humans, determining an approximate age of the human.

30. The method as recited in claim 28, further comprising:

determining an audio profile associated with the at least one human; and based at least in part on the audio profile, further adjusting the audio.

31. The method as recited in claim 28, wherein substantially equalizing the first detected volume of the audio at the target location from the first speaker with the second detected volume of the audio at the target location from the second speaker further comprises causing a motor associated with the first speaker to move the first speaker from a first physical location within the environment to a second physical location within the environment.

32. A method comprising:

receiving, from one or more sensors, data captured by the one or more sensors from an environment, the data including user authentication information and the environment including at least a first speaker and a second speaker outputting audio, the user authentication information comprising at least one of a pattern tapped onto a surface or user interaction with a reference object;

based at least in part on the data, determining that a human is present within the environment;

based at least in part on the user authentication information, determining an identity of the human;

determining an audio profile associated with the identity of the human;

based at least on the audio profile and at least one audio characteristic of the environment, adjusting at least one audio characteristic of audio that is being output, wherein the at least one audio characteristic includes at least one of an echo level, a reverb level, a sound-absorbing level, or a background noise level;

based at least in part on the data, determining a location of the human within the environment;

substantially equalizing a first detected volume level of the audio at the location from the first speaker with a second detected volume level of the audio at the location from the second speaker by instructing the first speaker to output the audio at a first modified volume level and instructing the second speaker to output the audio at a second modified volume level that is different than the first modified volume level;

determining that the human is changing or has changed location within the environment from the location to a new location; and substantially equalizing a third detected volume level of the audio at the new location from the first speaker with a fourth detected volume level of the audio at the new location from the second speaker by instructing the first speaker to output the audio at a third modified volume level and instructing the second speaker to output the audio at a fourth modified volume level that is different than the third modified volume level.

33. The method as recited in claim 32, wherein determining the identity of the human comprises:

determining one or more characteristics of the human based at least in part on the data; and comparing the one or more characteristics to characteristics of known humans.

34. The method as recited in claim 32, wherein the human is one of a plurality of humans within the environment, the method further comprising:

based at least in part on the data, determining a plurality of locations, wherein each location is associated with a different human of the plurality of humans within the environment;

determining a modified target location based at least in part on the plurality of locations; and further adjusting the audio to optimize the audio at the modified target location.

35. The method as recited in claim 34, wherein determining the modified target location comprises selecting an average location based on the plurality of locations.

36. A method comprising:

receiving, from one or more sensors, data captured by the one or more sensors from an environment, the environment including at least a first speaker and a second speaker outputting audio;

based at least in part on the data, detecting audio characteristics of the environment, wherein the audio characteristics of the environment include at least one of an echo level, a reverb level, a sound-absorbing level, or a background noise level;

based at least in part on the data, determining user authentication information associated with at least one of a first human or a second human within the environment, the user authentication information comprising at least one of a pattern tapped onto a surface of the environment or user interaction with a reference object, the first human having a first location within the environment and the second human having a second location within the environment;

determining that the first location is more frequently occupied than the second location;

based at least in part on the audio characteristics or the user authentication information, adjusting the audio output from the first speaker and the second speaker;

determining that at least one of the first human or the second human is changing or has changed location within the environment to a target location; and based at least in part on at least one of the first location being occupied more frequently than the second location or that the at least one of the first human or the second human is changing or has changed location, substantially equalizing a first detected volume level of the audio at the target location from the first speaker with a second detected volume level of the audio at the target location from the second speaker by instructing the first speaker to output the audio at a first modified volume level and instructing the second speaker to output the audio at a modified second volume level that is different than the first modified volume level.

37. The method as recited in claim 36, wherein the data indicates a surface type of a wall, ceiling, or floor within the environment.

38. The method of claim 36, wherein determining the target location within the environment comprises:

analyzing the data to identify a first object at the first location in the environment and a second object at the second location in the environment; and selecting an average location in the environment based on the first location and the second location.

* * * * *